US006883196B2

(12) United States Patent
Barber

(10) Patent No.: US 6,883,196 B2
(45) Date of Patent: Apr. 26, 2005

(54) ENCASED COIL INNERSPRING ASSEMBLY

(75) Inventor: James R. Barber, Anderson, IN (US)

(73) Assignee: Barber Manufacturing Company, Inc., Anderson, IN (US)

( * ) Notice: Subject to any disclaimer, the term of this patent is extended or adjusted under 35 U.S.C. 154(b) by 0 days.

(21) Appl. No.: 10/722,850

(22) Filed: Nov. 26, 2003

(65) Prior Publication Data

US 2004/0133988 A1 Jul. 15, 2004

Related U.S. Application Data

(60) Provisional application No. 60/429,696, filed on Nov. 27, 2002.

(51) Int. Cl.[7] ..... A47C 27/07

(52) U.S. Cl. ..... 5/720; 5/716; 5/655.8

(58) Field of Search ..... 267/91, 93, 94, 267/103; 5/716, 720, 727, 655.8

(56) References Cited

U.S. PATENT DOCUMENTS

| | | | | |
|---|---|---|---|---|
| 685,160 | A | | 10/1901 | Marshall |
| 698,529 | A | | 4/1902 | Marshall |
| 1,051,466 | A | | 1/1913 | Travis |
| 1,852,943 | A | | 5/1932 | Swanson |
| 1,930,697 | A | | 10/1933 | Stewart |
| 2,236,007 | A | | 3/1941 | Oldham |
| 2,504,352 | A | | 4/1950 | Robell |
| 2,558,288 | A | | 6/1951 | Backus |
| 2,568,055 | A | | 9/1951 | Clark |
| 2,715,435 | A | | 8/1955 | Rymland |
| 3,082,438 | A | | 3/1963 | Nachman, Jr. |
| 3,230,558 | A | | 1/1966 | Duncan |
| 3,626,523 | A | | 12/1971 | Robins |
| 4,234,983 | A | | 11/1980 | Stumpf |
| 4,234,984 | A | | 11/1980 | Stumpf |
| 4,451,946 | A | * | 6/1984 | Stumpf ..... 5/655.8 |
| 4,462,129 | A | | 7/1984 | Brannock |
| 4,523,344 | A | * | 6/1985 | Stumpf et al. ..... 5/655.8 |
| 4,578,834 | A | | 4/1986 | Stumpf |
| 4,677,701 | A | | 7/1987 | Galumbeck |
| 4,679,266 | A | | 7/1987 | Kraft |
| 4,726,572 | A | | 2/1988 | Flesher et al. |
| 4,771,495 | A | | 9/1988 | Distler et al. |
| 4,854,023 | A | | 8/1989 | Stumpf |
| 4,972,536 | A | | 11/1990 | Scott |
| 5,040,255 | A | | 8/1991 | Barber, Jr. |
| 5,062,172 | A | | 11/1991 | Stewart |
| 5,136,740 | A | | 8/1992 | Kraft |

(Continued)

FOREIGN PATENT DOCUMENTS

| | | |
|---|---|---|
| DE | 40 31 651 A1 | 10/1990 |
| DE | 297 10 267 U1 | 8/1997 |
| EP | 1 029 472 A1 | 8/2000 |
| FR | 2 697 420 | 10/1992 |
| WO | WO 91/10387 | 7/1991 |

*Primary Examiner*—Michael Trettel
(74) *Attorney, Agent, or Firm*—Woodard, Emhardt, Moriarty, McNett & Henry LLP

(57) ABSTRACT

An innerspring assembly comprising a plurality of strips of pocketed coil springs, each including axially interconnected spring pockets having a pocket height. The strips of pocketed coil springs are comprised of overlapping plies of material adjoined together by axially offset cross seams extending generally along the pocket height to define the spring pockets, with each spring pocket containing a coil spring. In one embodiment, the overlapping plies of at least two strips are coupled together by connecting seams extending along the pocket height and axially offset from the cross seams. In another embodiment, the overlapping plies of at least three strips are interconnected. In another embodiment, overlapping edges of the plies of material are adjoined by a closing weld seam positioned adjacent an end surface of the pocketed coil springs, with the overlapping plies of material of at least two strips interconnected by connecting welds positioned along the pocket height.

50 Claims, 7 Drawing Sheets

U.S. PATENT DOCUMENTS

| | | | | |
|---|---|---|---|---|
| 5,210,890 | A | | 5/1993 | Hagglund |
| 5,222,264 | A | | 6/1993 | Morry |
| 5,756,022 | A | | 5/1998 | Siegel et al. |
| 5,803,440 | A | | 9/1998 | Wells |
| 5,868,383 | A | | 2/1999 | Codos |
| 5,987,678 | A | | 11/1999 | Ayers |
| 6,101,697 | A | | 8/2000 | Stumpf |
| 6,131,892 | A | | 10/2000 | Stumpf |
| 6,256,820 | B1 | * | 7/2001 | Moser et al. ..... 5/655.8 |
| 6,260,331 | B1 | | 7/2001 | Stumpf |
| 6,272,706 | B1 | * | 8/2001 | McCune et al. ..... 5/720 |
| 6,347,423 | B1 | | 2/2002 | Stumpf |
| 6,398,199 | B1 | | 6/2002 | Barber |
| 6,540,214 | B2 | | 4/2003 | Barber |
| 6,574,811 | B1 | * | 6/2003 | Mossbeck ..... 5/655.8 |

* cited by examiner

ENCASED COIL INNERSPRING ASSEMBLY

REFERENCE TO RELATED APPLICATIONS

The present application claims the benefit of Provisional Application Ser. No. 60/429,696 filed on Nov. 27, 2002, the contents of which are hereby incorporated by reference in their entirety.

FIELD OF THE INVENTION

The present invention generally relates to coil innerspring assemblies, and more particularly relates to encased coil innerspring assemblies including strips or strings of interconnected pocketed coil springs that are coupled together to form a complete innerspring assembly.

BACKGROUND OF THE INVENTION

A variety of coil innerspring assemblies have been developed within the industry and have been in use for a number of years. Some of these coil innerspring assemblies are comprised of a number of coil springs that are individually encased within an outer spring pocket to form a corresponding number of pocketed coil springs. The spring pockets are typically fabricated by providing a sheet of fabric material that is folded approximately in half with transverse cross seams formed along the height of the spring pocket. The cross seams are spaced apart a distance somewhat greater than the outer diameter of the coil spring to form an appropriately sized spring pocket. A coil spring is inserted into the sleeve pocket and the overlapping edges of the sheet are attached together by a longitudinal seam to close the spring pocket.

In some instances, a series of the pocketed coil springs are interconnected to form an integral/continuous strip or string of pocketed coil springs. One example of a method for forming continuous strips of pocketed coil springs is illustrated and described in U.S. Pat. No. 6,398,199 to Barber, the contents of which are hereby incorporated herein by reference. The strings of pocketed coil springs may be coupled together to form a complete coil innerspring assembly.

One example of a method for coupling together strings of pocketed coil springs to form a complete innerspring assembly is illustrated and described in U.S. Pat. No. 6,398,199 to Barber. Top and bottom securing sheets or "scrims" may be used as a means for interconnecting strings of pocketed coil springs. The top and bottom scrims are secured to the upper and lower surfaces of the pocketed coil springs by an adhesive or other suitable means of attachment. However, the use of top and bottom scrims tends to increase material costs and the labor costs associated with securing the scrims to the pocketed coil springs.

Other methods have also been used to couple together individual pocketed coil springs or strings of pocketed coil springs. For example, rings or ties have been used to interconnect adjacent pocketed coil springs. Additionally, stitching or sewing techniques have been used to interconnect adjacent strings of pocketed coil springs. However, the labor costs associated with these methods of interconnection can also be significant.

While advances have been made in the industry, there is a continuing need for improved coil innerspring assemblies, particularly with regard encased coil innerspring assemblies formed of strips or strings of pocketed coil springs that are coupled together to form a complete encased coil innerspring assembly. The present invention meets this need and provides other benefits and advantages in a novel and unobvious manner.

SUMMARY OF THE INVENTION

The present invention relates generally to an innerspring assembly. While the actual nature of the invention covered herein can only be determined with reference to the claims appended hereto, certain forms of the invention that are characteristic of the preferred embodiments disclosed herein are described briefly as follows.

In one form of the invention, an innerspring assembly is provided which includes a plurality of strips of pocketed coil springs extending generally along an axis and including a plurality of axially interconnected spring pockets each having a pocket height. The strips of pocketed coil springs are comprised of overlapping plies of material adjoined together by axially offset cross seams extending generally along the pocket height to define the spring pockets, with each of the springs pockets containing a coil spring. At least two of the strips of pocketed coil springs are coupled together by interconnecting the overlapping plies of material of the least two strips by at least one connecting seam extending along the pocket height and axially offset from the cross seams.

In another form of the invention, an innerspring assembly is provided which includes a plurality of strips of pocketed coil springs extending generally along an axis and including a plurality of axially interconnected spring pockets each having a pocket height. The strips of pocketed coil springs are comprised of overlapping plies of material adjoined together by axially offset cross seams extending generally along the pocket height to define the spring pockets, with each of the springs pockets containing a coil spring. At least three of the strips of pocketed coil springs are coupled together by interconnecting the overlapping plies of material of the at least three strips.

In still another form of the invention, an innerspring assembly is provided which includes a plurality of strips of pocketed coil springs extending generally along an axis and including a plurality of axially interconnected spring pockets each having a pocket height. The strips of pocketed coil springs are comprised of overlapping plies of material adjoined together by axially offset cross seams extending generally along the pocket height to define the spring pockets, with each of the springs pockets containing a coil spring. Overlapping edges of the plies of material are adjoined together by a closing weld seam positioned adjacent an end surface of the pocketed coil springs. At least two of the strips of pocketed coil springs are coupled together by interconnecting the overlapping plies of material of the at least two strips by at least one connecting weld positioned along the pocket height.

In yet another form of the invention, an innerspring assembly is provided which includes a plurality of strips of pocketed coil springs extending generally along an axis and including a plurality of axially interconnected spring pockets each having a pocket height. The strips of pocketed coil springs are comprised of overlapping plies of material adjoined together by axially offset cross seams extending generally along the pocket height to define the spring pockets, with each of the springs pockets containing a coil spring. A first strip of the pocketed coil springs is laterally coupled to a second strip of the pocketed coil springs, with the first and second strips including a first set of laterally adjacent pairs of pocketed coil springs that are attached to one another, and a second set of laterally adjacent pairs of pocketed coil springs that are unattached to one another so as to permit independent movement therebetween.

It is one object of the present invention to provide an improved encased coil innerspring assembly.

Further objects, features, advantages, benefits, and/or further aspects of the present invention will become apparent from the drawings and description set forth herein.

BRIEF DESCRIPTION OF THE DRAWING FIGURES

DESCRIPTION OF THE ILLUSTRATED EMBODIMENTS

Figure 1:
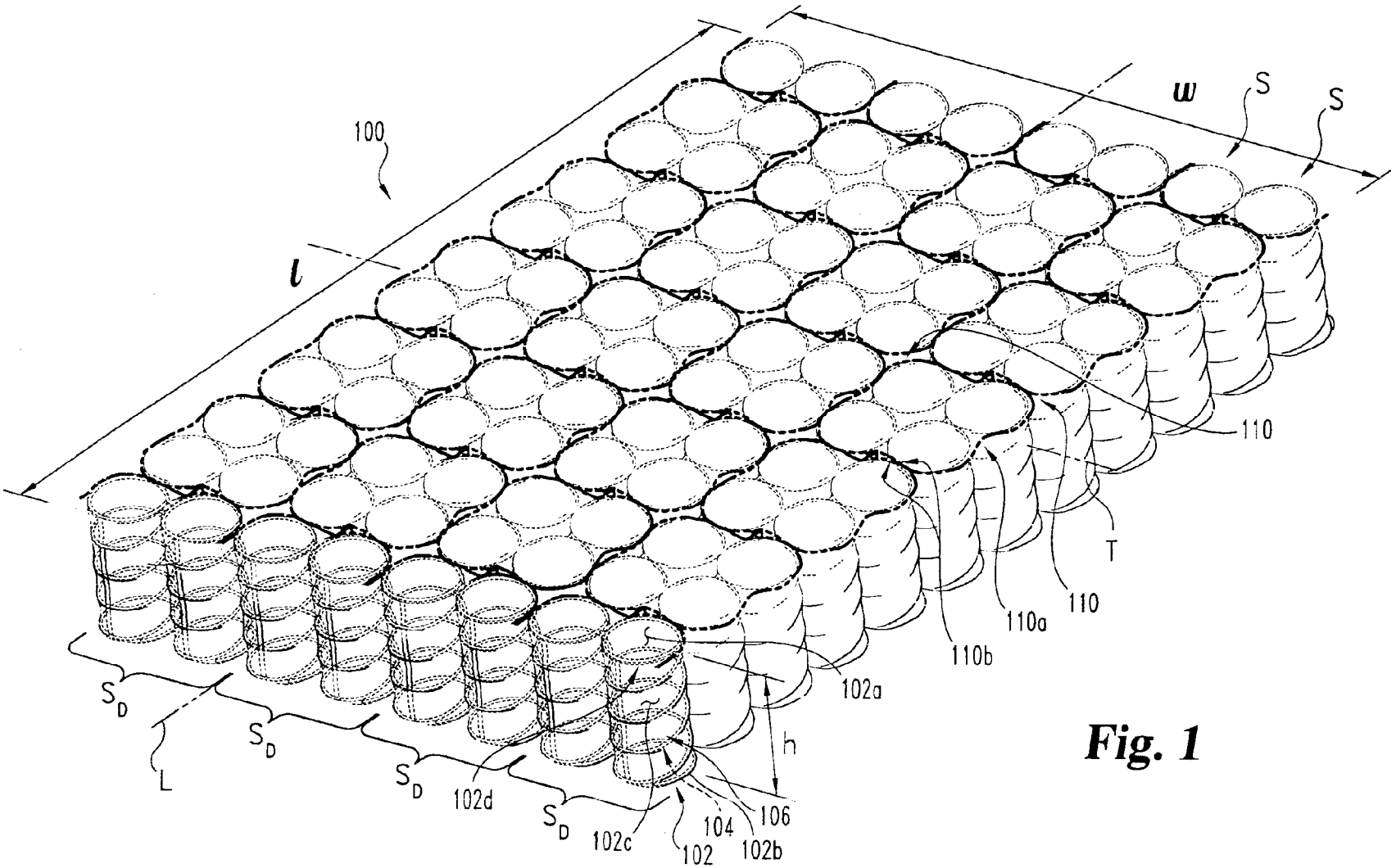
FIG. 1 is a side perspective view of an encased coil innerspring assembly according to one form of the present invention.

For the purposes of promoting an understanding of the principles of the invention, reference will now be made to the embodiments illustrated in the drawings and specific language will be used to describe the same. It will nevertheless be understood that no limitation of the scope of the invention is hereby intended, such alterations and further modifications in the illustrated devices, and such further applications of the principles of the invention as illustrated herein being contemplated as would normally occur to one skilled in the art to which the invention relates.

Referring to FIG. 1, shown therein is an encased coil innerspring assembly 100 according to one form of the present invention. The innerspring assembly 100 is generally comprised of a plurality of the pocketed coil springs 102 having a pocketed coil spring height h. The innerspring assembly 100 has a length l extending generally along a longitudinal axis L and a width w extending generally along a transverse axis T. As will be discussed in greater detail below, each of the pocketed coil springs 102 includes an inner coil spring 104 individually encased within an outer spring pocket 106.

In one aspect of the invention, the innerspring assembly 100 includes strips or strings S of interconnected pocketed coil springs 102. In the illustrated embodiment of the invention, the strips S of pocketed coil springs are arranged generally parallel with the longitudinal axis L, extending along the length l of the innerspring assembly 100 (i.e., in a head-to-toe direction). However, the strips S of pocketed coil springs may alternatively be arranged generally parallel with the transverse axis T, extending across the width w of the innerspring assembly 100 (i.e., in a side-to-side direction). In another aspect of the invention, adjacent strips S of the pocketed coil springs 102 are coupled together to form sections of dual strips $S_D$ and/or triple strips $S_T$ (FIG. 6) of pocketed coil springs. In a further aspect of the invention, single strips S, dual strip $S_D$ and/or triple strips $S_T$ of the pocketed coil springs 102 are coupled together to form the complete innerspring assembly 100. Further details regarding these aspects and other aspects of the present invention will be discussed below.

In one embodiment of the invention, the coil springs 104 used in association with the innerspring assembly 100 are formed from a metal spring wire such as, for example, high carbon spring wire or Marshall Pack spring wire. In a specific embodiment, the spring wire is automatic coiling and knotting high carbon spring wire. However, other types of spring wire are also contemplated as falling within the scope of the present invention. The diameter of the spring wire may vary depending on factors known to those of skill in the art including, for example, the amount of weight to be supported by the coil springs 104 as well and the desired firmness of the coil spring 104. In a specific embodiment, the diameter of the wire used to form the coil spring 104 is 15 gauge. However, other diameters or gauges of spring wire are also contemplated as falling within the scope of the present invention.

In the illustrated embodiment of the invention, the coil springs 104 are wound in a helical or spiral pattern so as to define a cylindrical-shaped outer profile. However, it should be understood that other shapes and configurations of coil springs are also contemplated for use in association with the present invention. For example, the coil springs 104 may alternatively define a barrel-shaped outer profile, an hourglass-shaped outer profile, or any other spring shape and/or configuration that would occur to one of skill in the art. Further details regarding other configurations of coil springs suitable for use in association with the present invention are illustrated and described in U.S. Pat. No. 6,398,199 to Barber and in co-pending U.S. Utility Application entitled "Coil Innerspring Assembly Having Varying Degrees of Firmness", the contents of which are hereby incorporated herein by reference.

In one embodiment of the invention, some, or possibly all, of the coil springs 104 may be subjected to a heat tempering process. Heat tempering tends to build memory into the coil springs 104. Heat tempering also tends to provide increased spring force/resistance and/or extended longevity of the action/resiliency of the coil springs 104. In one embodiment of the invention, the heat tempering process includes the step of heating the coil springs 104 to a temperature range between about 500° F. (260° C.) and about 600° F. (316° C.). In a specific embodiment, the coil springs 104 are heated to the appropriate temperature by running 50 amperes of current across the length of the spring wire for approximately one second. Further details regarding a heat tempering process suitable for use in association with the present invention are disclosed in U.S. Pat. No. 6,398,199 to Barber. However, it should be understood that other methods for heat tempering or heat treating the coil springs 104 are also contemplated as falling with the scope of the present invention.

As discussed above, in one embodiment of the invention, the coil springs 104 are each encased within an outer spring pocket 106 to form a number of individually pocketed coil springs 102. One purpose of encasing the coil springs 104 within the outer spring pockets 106 is to provide a means for interconnecting adjacent coil springs in series to form strips S of pocketed coil springs and/or to interconnect adjacent strips S of pocketed coil springs to form dual strips $S_D$ and/or triple strips $S_T$ of pocketed coil springs which can in turn be interconnected to form the innerspring assembly 100. Another purpose of the outer spring pockets 106 is to prevent adjacent coil springs from interfering with one another during compression and/or expansion. Yet another purpose of the outer spring pockets 106 is to maintain the coil springs 104 in a pre-compressed or pre-loaded state.

In the illustrated embodiment of the invention, the height h of the pocketed coil springs 102 is substantially uniform (e.g., with the top surfaces 102*a* and the bottom surfaces 102*b* of the pocketed coil springs 102 arranged substantially even or flush with one another). However, it should be understood that in other embodiments of the invention, the innerspring assembly 100 may be comprised of at least two sets of pocketed coil springs 102 having different pocketed heights so as to provide the innerspring assembly 100 with a varying or non-uniform height (e.g., with the top surfaces 102*a* and/or the bottom surfaces 102*b* of the pocketed coil springs 102 arranged at different elevations). In this manner, the innerspring assembly 100 may be configured to exhibit varying degrees of firmness. Further details regarding providing the innerspring assembly 100 with varying degrees of firmness are disclosed in co-pending U.S. Utility Application Ser. No. 10/723,561 entitled "Coil Innerspring Assembly Having Varying Degrees of Firmness", the contents of which having been incorporated herein by reference.

In one embodiment of the invention, the outer spring pockets 106 are formed from a fabric material that allows the fabric to be joined or welded together by heat and/or pressure, such as, for example, in a sonic or ultrasonic welding procedure or another type of thermal welding procedure. In another embodiment of the invention, the fabric material is comprised of a non-woven material. In a specific embodiment, the outer spring pockets 106 are formed from a non-woven, thermoplastic fiber material, such as, for example, a non-woven polymer-based material, a non-woven polypropylene material, a non-woven polyester material, or any other non-woven fabric material that would occur to one of skill in the art. It should be understood, however, that the outer spring pockets 106 may be formed from other materials, including woven materials and/or non polymer-based materials. For example, the spring pockets 106 may be formed from a wide variety of textile fabrics or other types of sheet materials known to those of skill in the art. Textile fabric materials are particularly well suited for applications involving stitching, stapling, or other similar methods of interconnecting textile fabric materials.

Referring collectively to FIGS. 1–4, according to one aspect of the invention, the innerspring assembly 100 is comprised of a plurality of integral/continuous strips or strings S of pocketed coil springs 102 that are interconnected to form dual strips $S_D$ and/or triple strips $S_T$ of pocketed coil springs 102, which are in turn interconnected to form a complete innerspring assembly 100.

Figure 2:
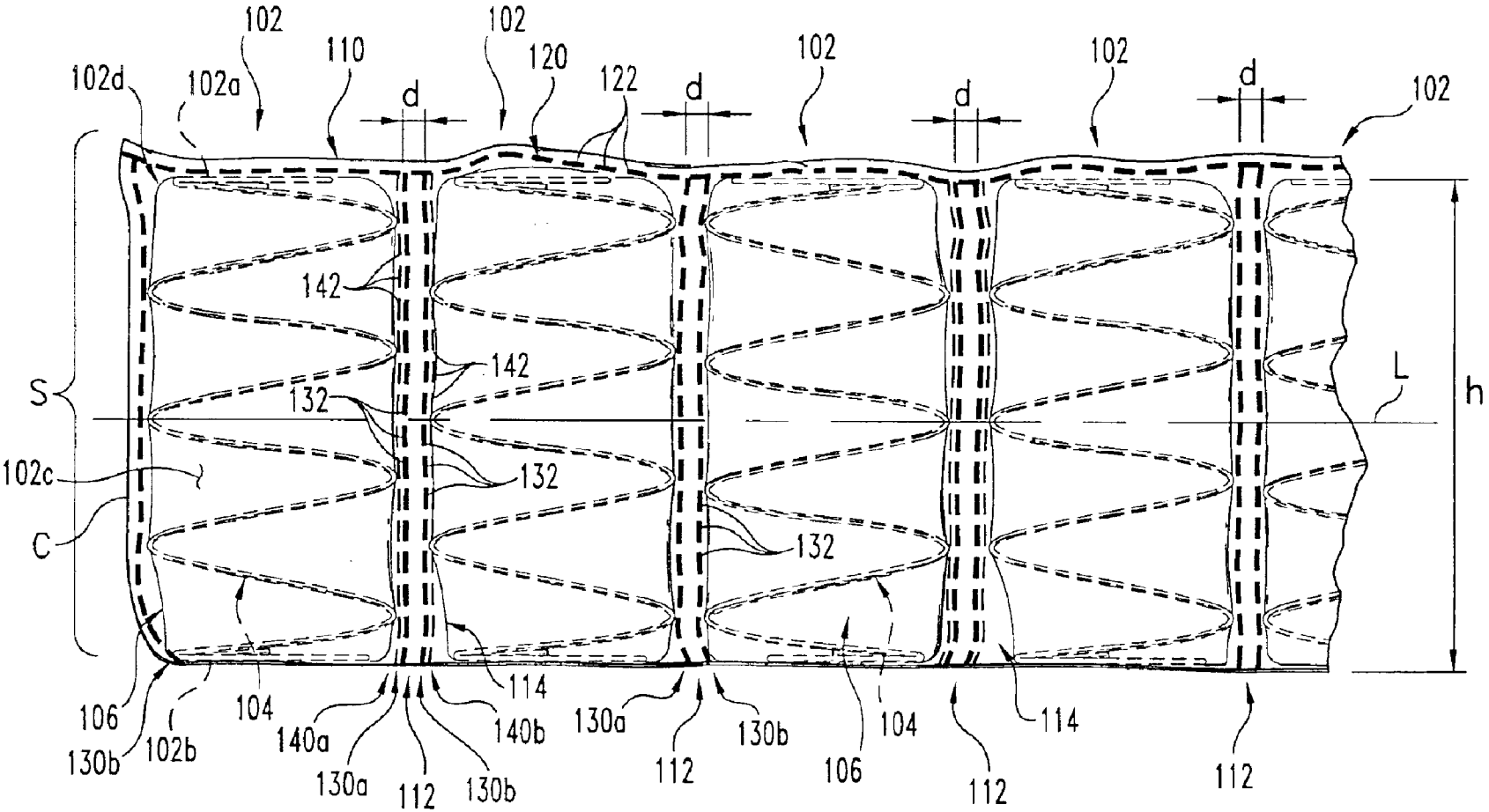
FIG. 2 is a partial side elevational view of the encased coil innerspring assembly illustrated in FIG. 1.

In the illustrated embodiment of the invention, the outer spring pockets 106 are formed by folding a sheet of fabric material in half to provide a two-ply sheet. As illustrated in FIG. 2, a horizontally-extending longitudinal closing seam 110 and a number of vertically-extending transverse cross seams 112 are formed at predetermined locations along the two-ply sheet to create the spring pockets 106. Each spring pocket 106 is sized and configured to accept an individual coil spring 104 to thereby form a strip S of pocketed coil springs 102. As will be discussed in greater detail below, two or more of the strips S of the pocketed coil springs may be interconnected by a vertically-extending transverse connecting seam 114 to form dual strips $S_D$ and/or triple strips $S_T$ of pocketed coil springs.

In one embodiment of the invention, the transverse cross seams 112 are initially formed along the two-ply sheet to adjoin the overlapping plies of material at predetermined locations. The cross seams 112 are offset from one another at an appropriate distance to form individual springs pockets 106 that are positioned so as to correspond with the final assembled position of the pocketed coil springs 102 within the strip S. Coil springs 104 are then inserted into the individual spring pockets 106 (through the upper openings) and the overlapping edges of the two-ply sheet are adjoined together by the longitudinal closing seam 110 to retain the coil springs 104 within the spring pockets 106, thereby forming a strip S of interconnected pocketed coil springs 102.

In another embodiment of the invention, a sheet of fabric material may be folded in half with the overlapping edges of the two-ply sheet adjoined together by the longitudinal closing seam 110 to form an elongate sleeve. Coil springs 104 are then be inserted into the elongate sleeve (through one of the side openings in the sleeve) and transverse cross seams 112 are formed along the two-ply sheet to adjoin the overlapping plies of material at the appropriate locations to create the individual spring pockets 106, thereby forming a strip S of interconnected pocketed coil springs 102. In yet another embodiment of the invention, a sheet of fabric material may be wrapped or folded about a row of the coil springs 104 prior to forming the longitudinal closing seam 110 and/or the transverse cross seams 112.

In one embodiment of the invention, the coil springs 104 may be pre-loaded to a compressed state prior to being encased within the outer sleeve pockets 106. As disclosed in U.S. Pat. No. 6,398,199 to Barber and co-pending U.S. Utility Application Ser. No. 10/723,561 entitled "Coil Innerspring Assembly Having Varying Degrees of Firmness", pre-loading the coil springs 104 to a compressed state has the effect of providing a relatively greater degree of firmness to the pocketed coil springs 102.

As should be appreciated, increasing the firmness of the pocketed coil spring 102 provides increased resistance to loading, which in turn provides a greater degree of support to the innerspring assembly 100. As should also be appreciated, the innerspring assembly 100 may include at least two sets of pocketed coil springs 102, with each set being pre-loading or pre-compressed by different amounts to provide the innerspring assembly 100 with varying degrees of firmness. In a specific embodiment of the invention, each set of the pocketed coil springs 102 may be formed from coil springs 104 having the same initial, uncompressed height and which are subsequently pre-loaded to a compressed state to define different pocketed coil spring heights. In another specific embodiment, each set of the pocketed coil springs 102 may be formed from coil springs 104 having different initial, uncompressed heights and which are subsequently pre-loaded to a compressed state to define substantially uniform pocketed coil spring heights.

In one aspect of the invention, the closing seam 110 is comprised of a horizontal weld seam 120. In the illustrated embodiment, the weld seam 120 is formed by a number of individual, discrete weld segments or stitches 122. However, it should be understood that the weld seam 120 may alternatively be formed as a substantially continuous weld seam. In a specific embodiment of the invention, the weld seam 120 may be formed, for example, by ultrasonic welding. The technique of ultrasonic welding is known in the art and therefore need not be discussed in detail herein. It should be understood, however, that other welding techniques are also contemplated, including, for example, contact heating, high frequency electrostatic welding, other types of thermal welding or any other welding technique known to those of skill in the art. It should also be understood that other methods of forming the closing seams 110 are also contemplated, including, for example, stitching, stapling or other methods of seaming known to those of skill in the art.

In another aspect of the invention, the transverse cross seams 112 are each comprised of a pair of vertical weld seams 130*a*, 130*b* that are arranged side-by-side in a substantially parallel arrangement and separated by a distance d. The distance d is sized to allow for the separation or division of an adjacent pair of the pocketed coil springs 102 between the vertical weld seams 130*a*, 130*b*. As should be appreciated, the inclusion of a pair of vertical weld seams 130*a*, 130*b* between the pocketed coil spring 102 allows for subsequent cutting of the strip S to a select length without having to sacrifice or compromise one of the separated pocketed coil springs 102.

More specifically, the strip S of the pocketed coil springs 102 may by divided along a cut line C disposed between the transverse weld seams 130*a*, 130*b* (FIG. 2). Notably, if a single transverse weld seam were used, one of the pocketed coil springs 102 adjacent the cut line C would be deprived of a transverse weld seam, thereby requiring that the opened pocketed coil springs 102 be discarded or that an additional transverse weld seam be formed to close the opened pocketed coil springs 102. Additionally, the inclusion of a pair of transverse weld seams 130*a*, 130*b* on each side of the pocketed coil springs 102 provides the outer spring pockets 106 and the strips S of pocketed coil spring with an added degree of strength and integrity. However, it should be understood that in another embodiment of the invention, the transverse cross seam 112 may be comprised of a single vertical weld seam positioned between and separating each of the pocketed coil springs 102. It should be appreciated that the strips S of the pocketed coil spring 102 may be cut along the cut line C via a number of devices or methods, such as, for example, a circular knife, a manual or air-actuated knife, a manual or air-actuated scissors, or any other device or method for cutting known to those of skill in the art. It should also be appreciated that the strips S of pocketed coil springs 102 may be cut to a select length either before or after formation of the dual strips $S_D$ of pocketed coil springs.

In the illustrated embodiment of the invention, each of the transverse weld seams 130*a*, 130*b* is formed by a number of individual, discrete weld segments 132. However, it should be understood that the transverse weld seams 130*a*, 130*b* may alternatively be formed as substantially continuous weld seams. In a specific embodiment of the invention, the weld seams 130*a*, 130*b* may be formed, for example, by ultrasonic welding. However, it should be understood that other welding techniques are also contemplated, including, for example, contact heating, high frequency electrostatic welding, other types of thermal welding or any other welding technique known to those of skill in the art. It should also be understood that other methods of forming the transverse cross seams 112 are also contemplated, including, for example, stitching, stapling or other methods of seaming known to those of skill in the art.

As shown in FIG. 1, in one embodiment of the invention, the closing seam 110 extends along the upper end surfaces 102*a* of the pocketed coil springs 102. More specifically, the closing seam 110 is positioned adjacent the upper edge or corner 102*d* formed between the upper surface 102*a* and the side surface 102*c*. The advantage gained by positioning the closing seam 110 along the upper surfaces 102*a* of the pocketed coil springs 102, and more specifically adjacent the upper edge or corner 102*d*, will be discussed in further detail below. It should be understood, however, that in other embodiments of the invention, the closing seam 110 may extend along other portions of the pocketed coil springs 102, including the lower surfaces 102*b* or the side surfaces 102*c*.

In the illustrated embodiment of the invention, the closing seam 110 includes axial portions 110*a* extending generally along the longitudinal axis L (along the length l) and lateral portions 110*b* extending generally along the transverse axis T (across the width w). Accordingly, the closing seam 110 defines a serpentine-type seam pattern winding along the length l of the innerspring assembly 100. In this manner, adjacent strips S of the pocketed coil springs 102 may be easily and conveniently coupled together, the details of which will be discussed below.

Figure 6:
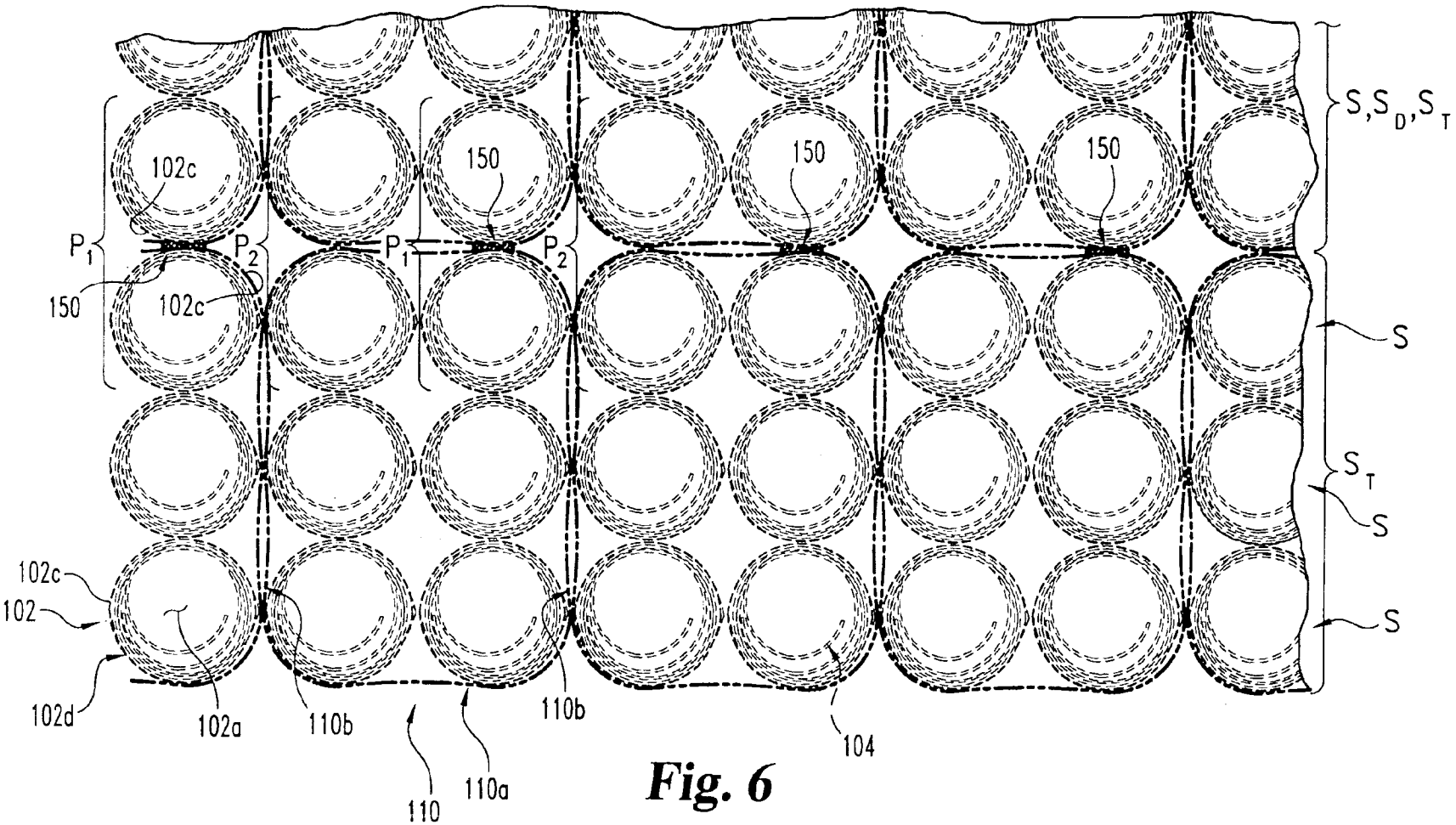
FIG. 6 is a partial top plan view of an alternative embodiment of the encased coil innerspring assembly illustrated in FIG. 1.

According to a further aspect of the invention, adjacent strips S of the pocketed coil springs 102 may be coupled together via a variety of methods. As used herein, the term "coupling" is broadly defined to encompass any means for connecting, attaching, affixing, adjoining, linking, or any other means for coupling one element to another element that would occur to one of skill in the art. In one embodiment of the invention, two adjacent strips S of pocketed coil springs are coupled together to form dual strips $S_D$ of pocketed coil springs 102. As illustrated in FIG. 6, it is also contemplated that three adjacent strips S of pocketed coil springs may be coupled together to form triple strips $S_T$ of pocketed coil springs. In still other embodiments of the invention, four of more adjacent strips S of pocketed coil springs may be coupled together to form multiple strips of pocketed coil springs.

In a preferred embodiment of the invention, adjacent strips S of the pocketed coil springs 102 are coupled together by a vertically-extending transverse connecting seam 114 (running along the pocketed height h) to form the dual strips $S_D$ and/or triple strips $S_T$ of pocketed coil springs 102. In a specific embodiment of the invention, the connecting seams 114 are each comprised of a pair of vertically-extending transverse weld seams 140*a* and 140*b* disposed on respective sides of the cross weld seams 130*a*, 130*b* that form the outer springs pockets 106 (i.e., with the connecting seams 140*a*, 140*b* straddling the cross seams 130*a*, 130*b*). The transverse weld seams 130*a*, 130*b* and 140*a*, 140*b* are preferably oriented in a substantially parallel arrangement relative to one another. However, it should be understood that other arrangements and orientations of the transverse weld seams 130*a*, 130*b* and 140*a*, 140*b* are also contemplated as falling with the scope of the invention.

As illustrated in FIG. 2, in one embodiment of the invention, the overlapping plies of material of adjacent strips S of pocketed coil springs 102 are interconnected via a transverse connecting seam 114 (e.g., weld seams 140*a*, 140*b*) formed between every other adjacent pair of pocketed coil springs 102. This particular method for interconnecting the adjacent strips S of pocketed coil springs 102 provides the innerspring assembly 100 with sufficient structural integrity and rigidity while minimizing manufacturing costs (e.g., requiring a minimal number of the connecting weld seams 140*a*, 140*b*). In another embodiment of the invention, the overlapping plies of material of adjacent strips S of pocketed coil springs 102 may be interconnected via a transverse connecting seam 114 formed between each of the pocketed coil springs 102. However, it should be appreciated that increasing the number of transverse connecting seams 114 tends to correspondingly increase the costs associated with manufacturing the innerspring assembly 100. In yet another embodiment of the invention, the overlapping plies of material of adjacent strips S of pocketed coil springs 102 may be interconnected via a transverse connecting seam 114 formed between every third adjacent pair of pocketed coil springs 102. However, it should be appreciated that decreasing the number of transverse connecting seams 114 tends to correspondingly decrease the structural integrity or rigidity of the innerspring assembly 100.

Figure 5:
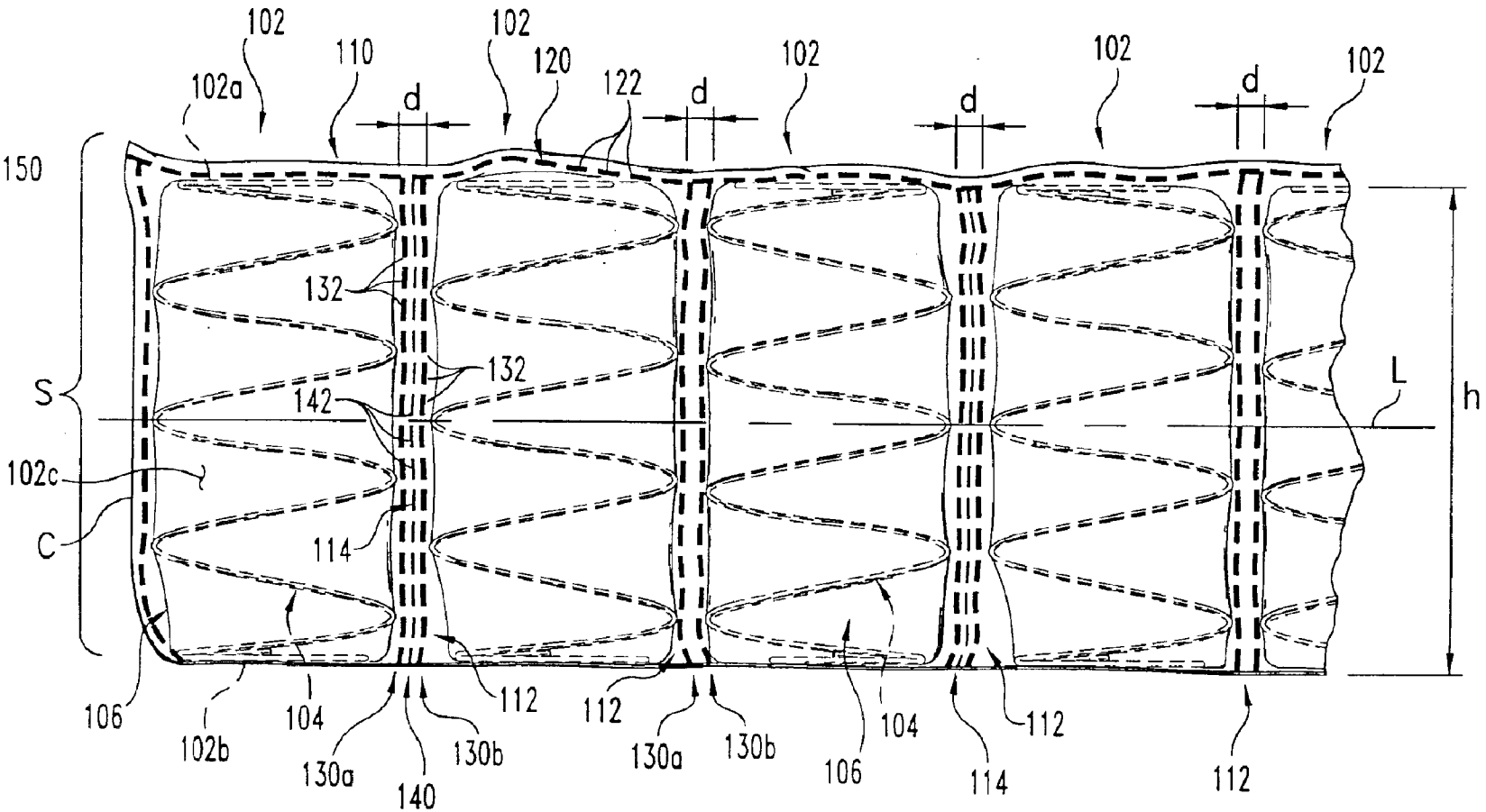
FIG. 5 is a partial side elevational view of an alternative embodiment of the encased coil innerspring assembly illustrated in FIG. 1.

The inclusion of a pair of connecting weld seams 140*a*, 140*b* to interconnect the overlapping plies of material of adjacent strips S of the pocketed coil springs 102 tends to provide the interconnection location with an added degree of strength and integrity. However, it should be understood that in another embodiment of the invention, the connecting seam 112 may be comprised of a single connecting weld seam positioned on either side of the cross weld seams 130*a*, 130*b*. Additionally, as illustrated in FIG. 5, in another embodiment of the invention, an individual connecting weld seam 140 may be positioned intermediate the cross weld seams 130*a*, 130*b* to interconnect adjacent strips S of the pocketed coil springs 102 to form the dual strips $S_D$ and/or triple strips $S_T$ of pocketed coil springs 102. As should be appreciated, this alternative arrangement has the advantage of interconnecting adjacent strips S of the pocketed coil springs with a minimum number of connecting weld seams.

In the illustrated embodiment of the invention, each of the transverse connecting weld seams 140*a*, 140*b* is formed by a number of individual, discrete weld segments or stitches 142. However, it should be understood that the connecting weld seams 140*a*, 140*b* may alternatively be formed as substantially continuous weld seams. In a specific embodiment of the invention, the weld seams 140*a*, 140*b* may be formed, for example, by ultrasonic welding. It should be understood, however, that other welding techniques are also contemplated, including, for example, contact heating, high frequency electrostatic welding, other types of thermal welding or any other welding technique known to those of skill in the art. It should also be understood that other methods of interconnecting adjacent strips S of the pocketed coil springs 102 are also contemplated, including, for example, stitching, stapling, gluing, adhering, taping, wiring, tying, fastening and/or any other method of attachment known to those of skill in the art.

As illustrated in FIG. 2, the transverse connecting weld seams 140*a*, 140*b* preferably do not overlap or intersect the transverse cross weld seams 130*a*, 130*b*. Instead the cross weld seams 130*a*, 130*b* and connecting weld seams 140*a*, 140*b* are offset from one another. Additionally, the cross weld seams 130*a*, 130*b* and connecting weld seams 140*a*, 140*b* preferably stop just short of the closing weld seam 120. One advantage of this arrangement is the avoidance of "re-welding" weld seams (e.g., welding over, through or across existing weld seams). Instead, each of the weld seams 120, 130*a*, 130*b*, 140*a*, 140*b* are formed along unwelded or "virgin" pocket fabric material.

Notably, it has been found that re-welding tends to result in degraded or inferior material compositions and a corresponding reduction in the strength and integrity of the connection locations in the areas of the re-welds. More specifically, areas of overlapping/intersecting welds or re-welds tend to create hardened and/or brittle weld material compositions, thereby weakening the connection locations in the areas of the overlapping/intersecting welds or re-welds and compromising the strength and integrity of the outer springs pockets 106 and/or the interconnection locations between the strips S, dual strips $S_D$ and/or triple strips $S_T$ of the pocketed coil springs. The present invention eliminates, or at the very least minimizes, overlapping/intersecting welds and/or re-welds to thereby provide stronger, more reliable pocketed coil springs 102 and a more secure and reliable interconnection between adjacent strips S of the pocketed coil springs.

As discussed above, the closing seam 110, and more particularly the closing weld seam 120, is preferably positioned along the upper surfaces 102*a* of the pocketed coil springs 102, and more specifically adjacent the upper edge or corner 102*d* formed between the upper surface 102*a* and the side surface 102*c*. Positioning the closing weld seam 120 along the upper surface 102*a* of the pocketed coil springs avoids intersection with the cross weld seams 130*a*, 130*b* and/or the connecting weld seams 140*a*, 140*b*, which correspondingly avoids intersecting welds/re-welds to thereby provide a stronger and more reliable innerspring assembly 100.

Moreover, since the closing seam 110 is positioned adjacent the upper edge or corner 102*d* of the pocketed coil springs 102, following the completion of the welding procedures, the overlapping longitudinal edges of the sheeting material adjacent the closing seam 110 can be folded down over the upper end portion of the side surfaces 102*c*. In this manner, the closing seam 110 will not interfere with or effect the "feel" of the innerspring assembly 100, as some experts contend would otherwise contribute to an undesirable different feel between opposite sides of the innerspring assembly 100. In other words, some experts would argue that an upstanding closing seam or margin extending directly across the upper surfaces 102*a* of the pocketed coil springs 102 may be felt or sensed by an occupant lying on the innerspring assembly 100, which would not be the case if the innerspring assembly 100 were flipped over so that the seamless lower surfaces 102*b* of the pocketed coil springs 102 face an upward direction. The overlapping longitudinal edges of the sheeting material can also be secured to the upper end portion of the side surfaces 102*c* by a number of different methods including, for example, tack welding, stitching, stapling, gluing, adhering, taping, wiring, tying, fastening and/or any other method of attachment known to those of skill in the art.

In one embodiment of the invention, the spring pockets 106 are preferably formed so as to fit snuggly or tightly about the coil springs 104. A snug fit between the spring pocket 106 and the coil spring 104 tends to improve the performance and/or spring efficiency of the coil spring 104 by confining the working action or movement of the coil spring 104 in a vertical direction (i.e., straight up and down). It should be appreciated that the snugness or tightness of the spring pockets 106 about the coil springs 104 is determined, at least in part, by the location and configuration of the transverse cross seams 112 and/or the transverse connecting seams 114. Additionally, the relative length of the pocket material associated with the lateral portions 110*b* of the closing seam 110 also tends to effect the snugness of the spring pockets 106 about the coil springs 104. More specifically, increasing the length of the pocket material associated with the lateral portions 110*b* tends to provide a looser fit while decreasing such length tends to provide a tighter or snugger fit.

It should also be appreciated that the snugness or tightness of the spring pockets 106 about the coil springs 104 may also be effected by the particular process used to form the transverse connecting weld seams 140*a*, 140*b*. In one embodiment of the invention, the connecting weld seams 140*a*, 140*b* are formed by positioning a welding head on one side of a coil strand S and a welding anvil on the opposite side of an adjacent coil strand S. As the welding head is displaced toward the welding anvil, the welding head will come in contact with the spring pocket material and will press against the adjacent coil springs 104. As a result, the tension in the spring pocket material is increased as the adjacent coils springs 104 are urged away from the welding head toward the oppositely disposed transverse cross weld seam 130*a*, 130*b*. Following formation of the connecting weld seams 140*a*, 140*b*, the spring pockets 106 will remain snuggly engaged about the coil springs 104.

Figure 3:
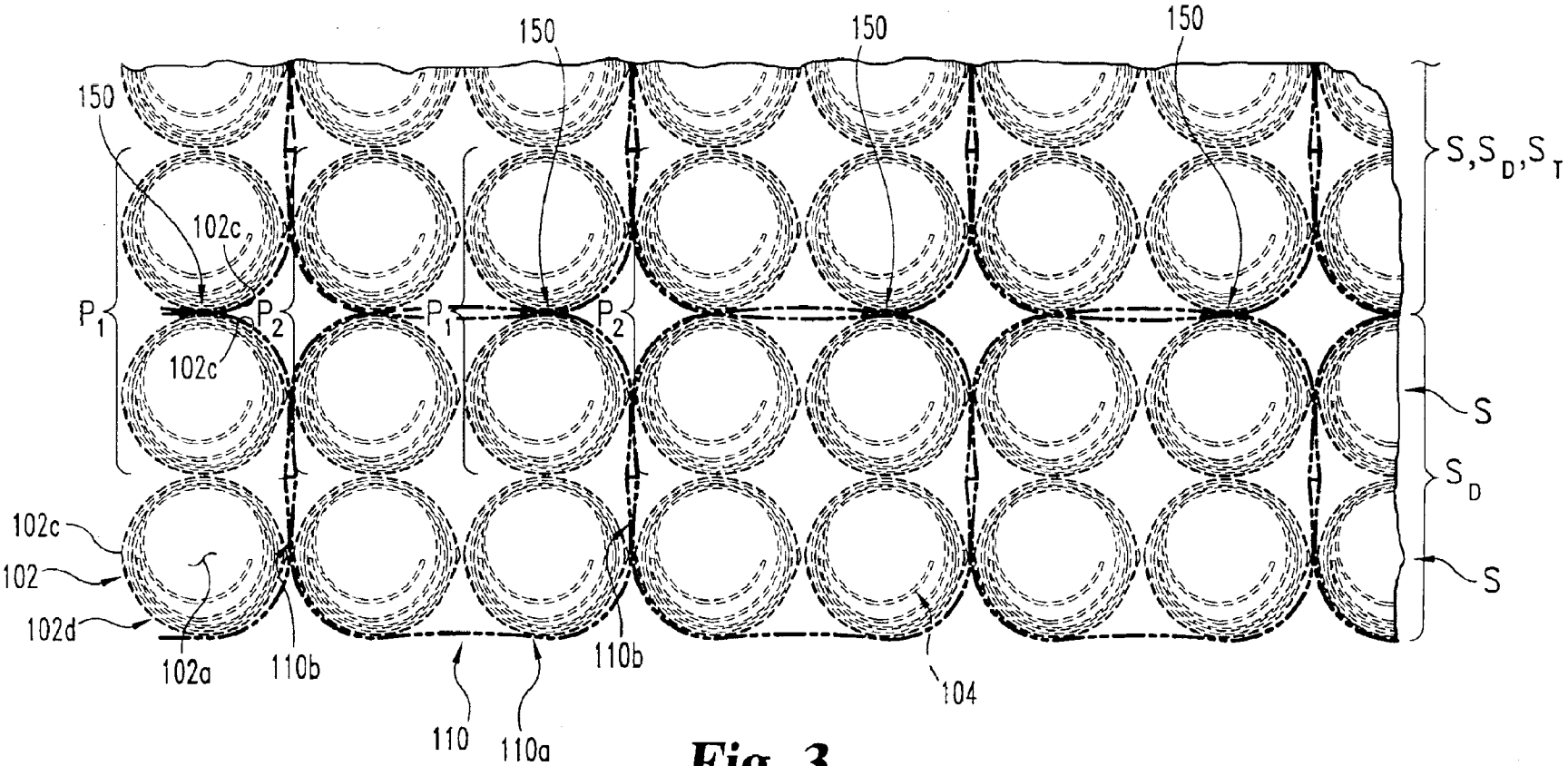
FIG. 3 is a partial top plan view of the encased coil innerspring assembly illustrated in FIG. 1.
Figure 4:
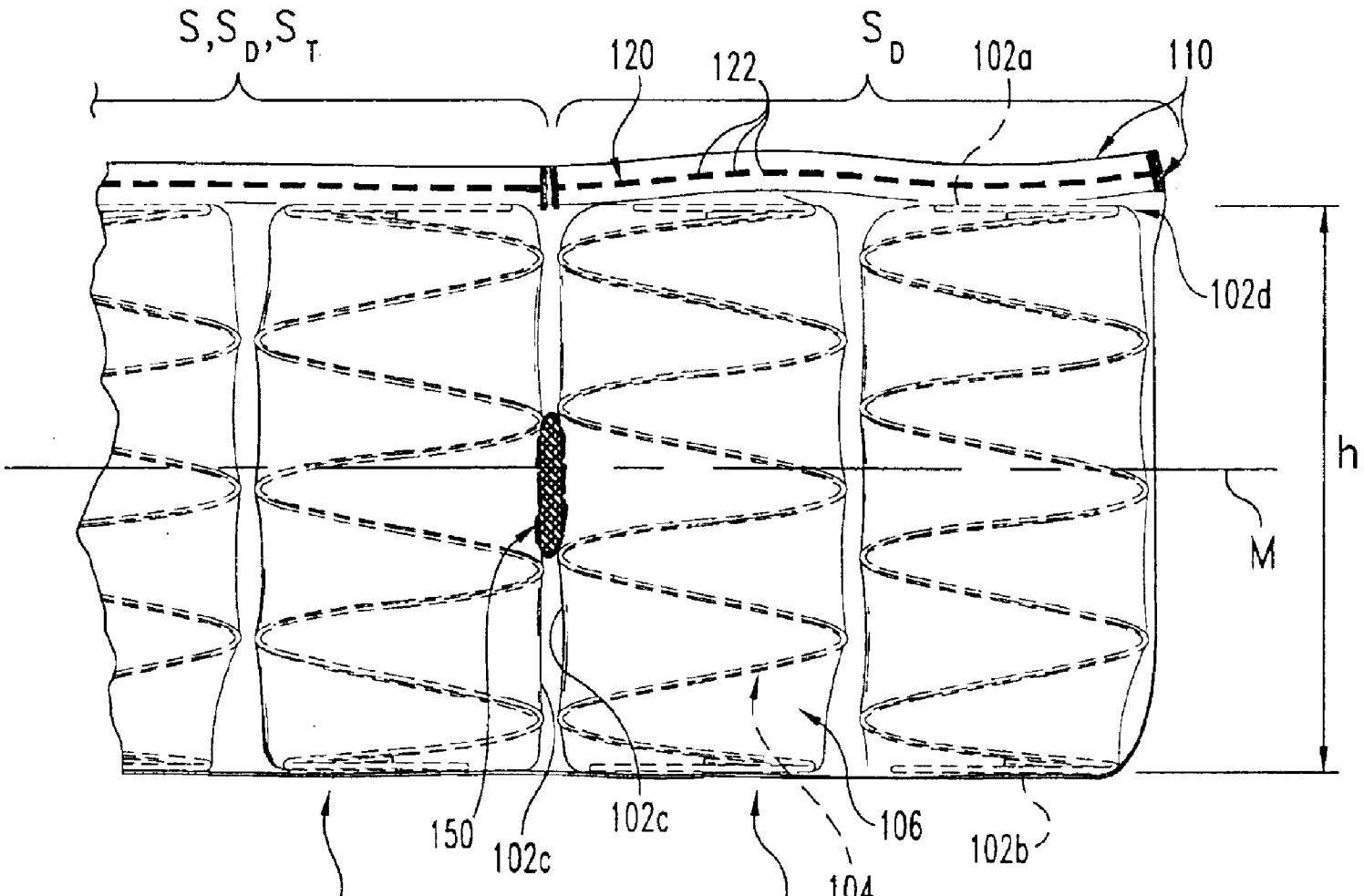
FIG. 4 is a partial end elevational view of the encased coil innerspring assembly illustrated in FIG. 1.

According to another aspect of the invention, single strips S, dual strips $S_D$ and/or triple strips $S_T$ of pocketed coil springs 102 may be coupled together in various combinations to form the complete innerspring assembly 100. Referring specifically to FIGS. 3 and 4, in one embodiment of the invention, the dual strip $S_D$ of pocketed coil springs 102 is attached or adjoined to an adjacent individual strip S, dual strip $S_D$ and/or triple strips $S_T$ at attachment locations 150. In a specific embodiment, the dual strip $S_D$ are attached to an adjacent individual strip S, dual strip $S_D$ and/or triple strips $S_T$ at attachment locations 150 via gluing. However, other methods of attachment are also contemplated as would occur to one of skill in the art, including, for example, taping, stitching, stapling, wiring, tying, fastening and/or any other method of attachment known to those of skill in the art.

In a specific embodiment of the invention, the gluing technique utilizes a hot melt adhesive applied to the side surface 102*c* of the pocketed coil springs 102 by a hot melt applicator. However, other gluing or adhering techniques are also contemplated as would occur to one of skill in the art. For example, glue may be applied to the side surface 102*c* of the pocketed coil springs 102 via a brush or roller. Alternatively, a spray adhesive may be applied to the side surface 102*c* of the pocketed coil springs 102 via a spray applicator.

As shown in FIG. 4, in one embodiment of the invention, the adjacent pairs $P_1$ of pocketed coil springs 102 are glued together at the waist or mid-portion of the pocket side surfaces 102*c*. In other words, the glue locations 150 are positioned along a central midline axis M extending along the pocketed coil springs 102. This method of gluing is particularly advantageous if barrel-shaped pocketed coil springs are utilized. However, it should be understood that other glue locations 150 are also contemplated as falling within the scope of the present invention, including glue locations at or near the upper pocket surfaces 102*a* and/or the lower pocket surfaces 102*b*. Additionally, it is also contemplated that the adjacent pairs $P_1$ of pocketed coil springs 102 may be attached together by a glue line or strip extending along substantially the entire height h of the side surface 102*c*, or by a series of discrete glue beads or strips disposed intermittently along at least a portion of the height h of the side surface 102*c*.

As discussed above, the dual strip $S_D$ of pocketed coil springs 102 is attached to an adjacent single strip S, dual strip $S_D$ and/or a triple strip $S_T$. In the illustrated embodiment of the invention, every other adjacent pair $P_1$ of pocketed coil springs 102 is attached together at attachment locations 150, with the intervening pairs $P_2$ of pocketed coil springs 102 remaining unattached to one another. It should be appreciated that attachment of every other adjacent pair $P_1$ of pocketed coil springs 102 (as opposed to every adjacent pair) tends to provide independent spring action or movement between the adjacent single strips S, dual strips $S_D$ and/or a triple strips $S_T$ of pocketed coil springs 102. In other words, permitting the unattached pairs $P_2$ of pocketed coil springs 102 to move or shift relative to one another correspondingly allows the coil springs 104 to be independently compressed and/or expanded, thereby tending to enhance the responsiveness and/or comport of the innerspring assembly 100. It should be understood, however, that in other embodiments of the invention, every adjacent pair, every third adjacent pair, etc., of the pocketed coil springs 102 may be coupled together to form the innerspring assembly 100.

In another embodiment of the invention, a top sheeting member (not shown) and/or a bottom sheeting member (not shown), sometimes referred to as top and bottom scrims, may be used to further secure the single strips S, dual strips $S_D$ and/or triple strips $S_T$ of pocketed coil springs and/or to further stabilize the coil innerspring assembly 100. More specifically, the single strips S, dual strips $S_D$, and/or triple strips $S_T$ of pocketed coil springs may be interconnected via a top securing sheet or scrim (not shown) and/or a bottom securing sheet or scrim (not shown) to form the innerspring assembly 100.

The top and bottom scrims may be formed of the same fabric material as the outer spring pockets 106 or may be formed of a material that is softer and/or more stretchable than the spring pocket material, such as, for example, a polypropylene or polyester material. Textile fabrics or other materials known to those of skill in the art may also be used. The top and bottom scrims may be attached to the upper and lower surfaces 102*a* and 102*b*, respectively, of the pocketed coil springs 102 such as, for example, by a hot melt adhesive. However, other methods of attachment are also contemplated as would occur to one of skill in the art. It should also be understood that the top and bottom scrims are optional and are not necessarily required to form the innerspring assembly 100. Further details regarding the use of top and bottom scrims are illustrated and described in U.S. Pat. No. 6,398,199 to Barber, the contents of which have been incorporated herein by reference.

Figure 7:
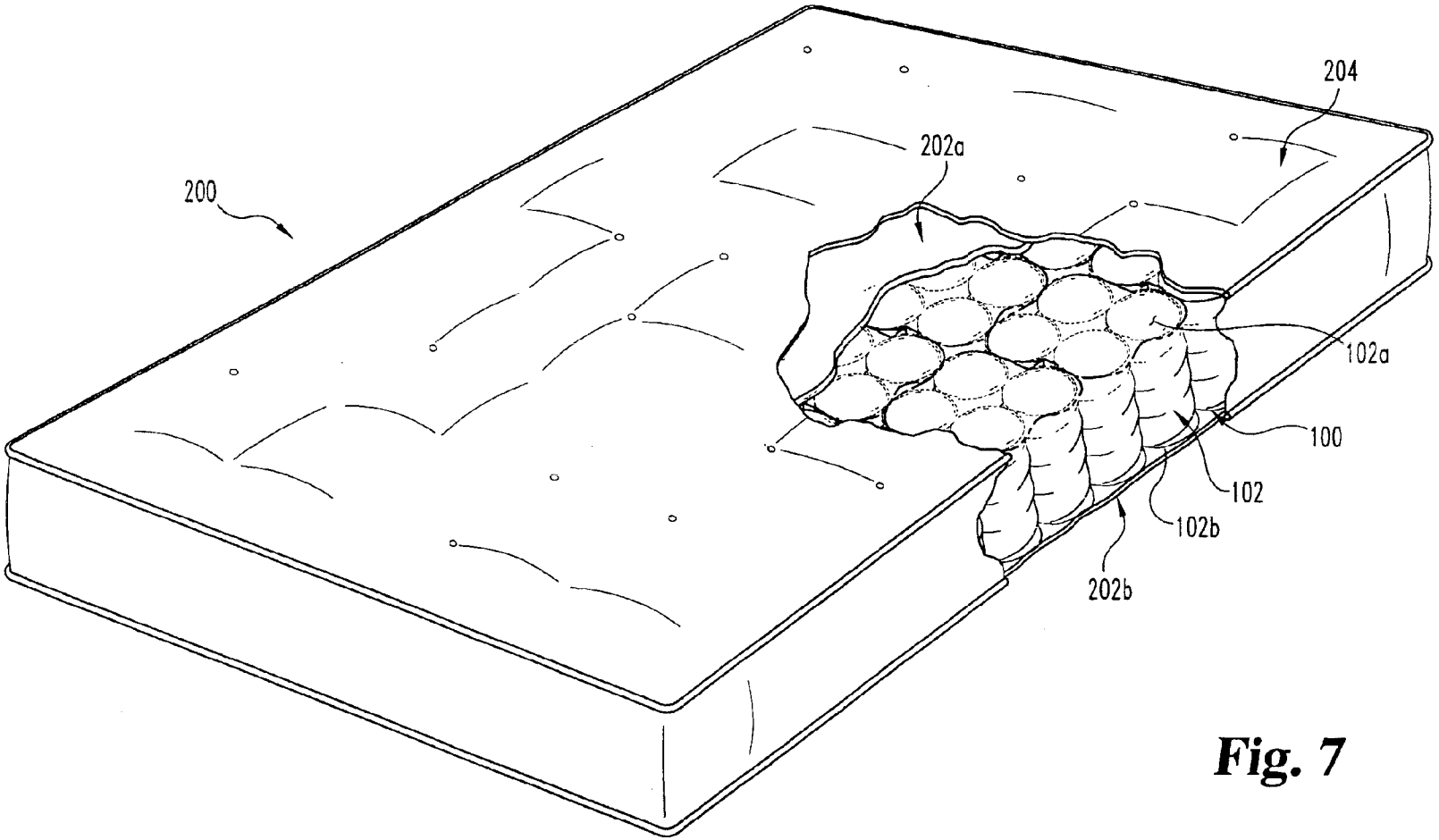
FIG. 7 is a side perspective view of the innerspring assembly illustrated in FIG. 1, as integrated into an innerspring mattress according to one embodiment of the present invention.

Referring now to FIG. 7, shown therein is an innerspring mattress assembly 200 according to one form of the present invention. In one embodiment, the innerspring mattress assembly 200 is comprised of the innerspring assembly 100, a sheet of padding material 202*a* extending along the top of the innerspring assembly 100, a sheet of padding material 202*b* extending along the bottom of the innerspring assembly 100, and an outer covering 204 extending about the entire innerspring assembly 100. However, other configurations of innerspring mattress assemblies are also contemplated as falling within the scope of the present invention.

The sheets of padding material 202*a*, 202*b* may include, for example, sheets of foam, filling material, and/or any other type of mattress padding material that would occur to one of skill in the art. In one embodiment of the invention, the sheets of padding material 202*a*, 202*b* are attached directly to the upper and lower surfaces 102*a*, 102*b*, respectively, of the pocketed coil springs 102. If the innerspring assembly 100 includes top and/or bottom scrims (not shown), the sheets of padding material 202*a*, 202*b* may be attached to the outer surfaces of the top and bottom scrims, respectively. In one embodiment of the invention, the sheets of padding material 202*a*, 202*b* are attached to the pocketed coil springs 102 (or the top and bottom scrims) via an adhesive material, such as, for example, a hot melt adhesive. However, other methods of attachment are also contemplated as would occur to one of skill in the art. It should be appreciated that the sheets of padding material 202*a*, 202*b* may include more than one layer of material arranged in a stacked configuration to form multi-layered sheets of padding material 202*a*, 202*b*.

The outer covering 204 may include, for example, an upholstery covering or any other type of mattress upholstery material that would occur to one of skill in the art. In one embodiment of the invention, the outer covering 204 is attached to the sheets of padding material 202*a*, 202*b* via conventional upholstering techniques. However, other methods of attachment are also contemplated as would occur to one of skill in the art.

It should be understood that the innerspring assembly 100 may include one or more of the elements, structures, features, characteristics or arrangements illustrated and described in co-pending U.S. Utility Application Ser. No. 10/723,561 entitled "Coil Innerspring Assembly Having Varying Degrees of Firmness" to form additional embodiments of the present invention. For example, the innerspring assembly 100 may include at least two sets of pocketed coil springs having different pocketed heights and/or having upper and lower surfaces disposed at different elevations to provide the innerspring assembly 100 with varying degrees of firmness. Additionally, the innerspring assembly 100 may include at least two sets of pocketed coil springs having different coil configurations, such as, for example, one set having a barrel-shaped outer profile and another set having an hourglass-shaped outer profile. The innerspring assembly 100 may also include at least two sets of pocketed coil springs having different coil diameters.

It should also be understood that the innerspring assembly 100 may include one or more of the elements, structures, features, characteristics or arrangements illustrated and described in U.S. Pat. No. 6,398,199 to Barber. For example, the innerspring assembly 100 may include two or more posturized sections or zones exhibiting different degrees of firmness. In a specific example, the innerspring assembly 100 may include three discrete posturized sections or zones extending across the width w to accommodate particular loading requirements associated with various regions of the occupant's body (e.g., the head, torso and leg regions) when lying on the innerspring assembly 100 in a prone position. In another example, the innerspring assembly 100 may also include two discrete posturized sections or zones extending along the length l to accommodate particular loading requirements associated with two different occupants.

While the invention has been illustrated and described in detail in the drawings and foregoing description, the same is to be considered as illustrative and not restrictive in character, it being understood that only the preferred embodiments have been shown and described, and that all changes and modifications that come within the spirit of the invention are desired to be protected.

What is claimed is:

1. An innerspring assembly, comprising:

a plurality of strips of pocketed coil springs extending generally along an axis, each of said strips including a plurality of axially interconnected spring pockets each having a pocket height transverse to said axis, each of said strips comprising overlapping plies of material adjoined together by axially offset cross seams extending generally along said pocket height to define said spring pockets, each of said springs pockets containing a coil spring; and wherein at least two of said strips of pocketed coil springs are coupled together by interconnecting said overlapping plies of material of said at least two strips by at least one connecting seam extending along said pocket height and axially offset from said cross seams.

2. The innerspring assembly of claim 1, wherein said connecting seam extends substantially entirely along said pocket height.

3. The innerspring assembly of claim 1, wherein said connecting seam is arranged substantially parallel with said cross seams.

4. The innerspring assembly of claim 3, wherein said connecting seam is disposed proximately adjacent one of said cross seams.

5. The innerspring assembly of claim 1, wherein each of said cross seams comprises at least one cross weld seam; and wherein said connecting seam comprises at least one connecting weld seam.

6. The innerspring assembly of claim 5, wherein said at least one cross weld seam and said at least one connecting weld seam are formed by ultrasonic welding.

7. The innerspring assembly of claim 5, wherein said at least one cross weld seam and said at least one connecting weld seam are each comprised of a plurality of discrete weld segments.

8. The innerspring assembly of claim 1, wherein each of said cross seams comprises a pair of axially offset cross weld seams.

9. The innerspring assembly of claim 8, wherein said at least one connecting seam comprises a pair of axially offset connecting weld seams disposed on either side of said pair of axially offset cross weld seams.

10. The innerspring assembly of claim 8, wherein said at least one connecting seam comprises at least one connecting weld seam disposed intermediate said pair of axially offset cross weld seams.

11. The innerspring assembly of claim 1, wherein said at least one connecting weld seam comprises a pair of axially offset connecting weld seams.

12. The innerspring assembly of claim 11, wherein each of said cross seams comprises at least one cross weld seam disposed intermediate said pair of axially offset connecting weld seams.

13. The innerspring assembly of claim 12, wherein each of said cross seams comprises a pair of axially offset weld seams disposed intermediate said pair of axially offset connecting weld seams.

14. The innerspring assembly of claim 1, wherein each of said pocketed coil springs in said at least two strips has a substantially uniform pocket height.

15. The innerspring assembly of claim 1, wherein overlapping edges of said overlapping plies of material are adjoined together by a closing seam positioned adjacent an end surface of said pocketed coil springs.

16. The innerspring assembly of claim 15, wherein said closing seam is disposed proximately adjacent a corner of said pocketed coil springs defined between said end surface and a side surface of said pocketed coil springs.

17. The innerspring assembly of claim 15, wherein said connecting seam comprises at least one connecting weld seam; and wherein said closing seam comprises a closing weld seam.

18. The innerspring assembly of claim 17, wherein said connecting weld seam does not intersect said closing weld seam.

19. The innerspring assembly of claim 1, wherein said at least two strips of pocketed coil springs comprise a section of pocketed coil springs; and wherein the innerspring assembly comprises at least two of said sections of pocketed coil springs.

20. The innerspring assembly of claim 19, wherein said at least two sections of pocketed coil springs are interconnected to form at least a portion of the innerspring assembly.

21. The innerspring assembly of claim 20, wherein said at least two sections of pocketed coil springs are interconnected by an adhesive.

22. The innerspring assembly of claim 21, wherein laterally adjacent pairs of said pocketed coil springs in said at least two sections of pocketed coil springs are interconnected by said adhesive along a midportion of said pocket height.

23. The innerspring assembly of claim 19, wherein said at least two sections of pocketed coil springs have varying degrees of firmness.

24. The innerspring assembly of claim 1, wherein the innerspring assembly is integrated into an innerspring mattress assembly.

25. An innerspring assembly, comprising:

a plurality of strips of pocketed coil springs extending generally along an axis, each of said strips including a plurality of axially interconnected spring pockets each having a pocket height transverse to said axis, each of said strips comprising overlapping plies of material adjoined together by axially offset cross seams extending generally along said pocket height to define said spring pockets, each of said springs pockets containing a coil spring; and wherein at least three of said strips of pocketed coil springs are coupled together by interconnecting said overlapping plies of material of said at least three strips.

26. The innerspring assembly of claim 25, wherein said overlapping plies of material of said at least three strips of pocketed coil springs are interconnected by welding.

27. The innerspring assembly of claim 25, wherein said overlapping plies of material of said at least three strips are interconnected by at least one connecting seam extending generally along said pocket height and axially offset from said cross seams.

28. The innerspring assembly of claim 27, wherein said connecting seam is arranged substantially parallel with said cross seams.

29. The innerspring assembly of claim 27, wherein said cross seams and said connecting seam are formed by ultrasonic welding.

30. An innerspring assembly, comprising:

a plurality of strips of pocketed coil springs extending generally along an axis, each of said strips including a plurality of axially interconnected spring pockets each having a pocket height transverse to said axis, each of said strips comprising overlapping plies of material adjoined together by axially offset cross seams extending generally along said pocket height to define said spring pockets, each of said springs pockets containing a coil spring, overlapping edges of said plies of material adjoined together by a closing weld seam positioned adjacent an end surface of said pocketed coil springs; and wherein at least two of said strips of pocketed coil springs are coupled together by interconnecting said overlapping plies of material of said at least two strips by at least one connecting weld positioned along said pocket height.

31. The innerspring assembly of claim 30, wherein said connecting weld comprises a connecting weld seam extending generally along said pocket height.

32. The innerspring assembly of claim 31, wherein said connecting weld seam extends substantial entirely along said pocket height.

33. The innerspring assembly of claim 31, wherein said cross seams comprise cross weld seams axially offset from said connecting weld seam.

34. The innerspring assembly of claim 30, wherein said connecting weld does not intersect said closing weld seam.

35. The innerspring assembly of claim 30, wherein said closing weld seam and said connecting weld are formed by ultrasonic welding.

36. The innerspring assembly of claim 30, wherein said closing weld seam is disposed proximately adjacent a corner of said pocketed coil springs defined between said end surface and a side surface of said pocketed coil springs.

37. The innerspring assembly of claim 36, wherein closing weld seam winds along said axis in a serpentine-type pattern.

38. The innerspring assembly of claim 36, wherein said overlapping edges adjoined together by said closing weld seam are folded over onto said side surface of said pocketed coil springs.

39. The innerspring assembly of claim 38, wherein said overlapping edges adjoined together by said closing weld seam are attached to said side surface of said pocketed coil springs.

40. An innerspring assembly, comprising:

a plurality of strips of pocketed coil springs extending generally along an axis, each of said strips including a plurality of axially interconnected spring pockets each having a pocket height transverse to said axis, each of said springs pockets containing a coil spring; and wherein a first strip of said pocketed coil springs is laterally coupled to a second strip of said pocketed coil springs, said first and second strips including:

a first set of laterally adjacent pairs of pocketed coil springs that are attached to one another; and a second set of laterally adjacent pairs of pocketed coil springs that are unattached to one another so as to permit independent movement therebetween.

41. The innerspring assembly of claim 40, wherein said first set of laterally adjacent pairs of pocketed coil springs are attached to one another by an adhesive.

42. The innerspring assembly of claim 41, wherein said adhesive is glue.

43. The innerspring assembly of claim 41, wherein said first set of laterally adjacent pairs of pocketed coil springs are attached to one another by said adhesive along a midportion of said pocket height.

44. The innerspring assembly of claim 43, wherein said pocketed coil springs have a barrel-shaped outer profile.

45. The innerspring assembly of claim 40, wherein laterally adjacent pairs of said first set of pocketed coil springs are intermittently positioned between laterally adjacent pairs of said second set of pocketed coil springs.

46. The innerspring assembly of claim 45, wherein laterally adjacent pairs of said first set of pocketed coil springs are alternatingly positioned relative to laterally adjacent pairs of said second set of pocketed coil springs.

47. The innerspring assembly of claim 40, wherein each of said strips of pocketed coil springs is comprised of overlapping plies of material adjoined together by axially offset cross seams extending generally along said pocket height to define said spring pockets; and wherein at least one of said first and second strips of pocketed coil springs is coupled to at least one additional strip of said pocketed coil springs by interconnecting said overlapping plies of material.

48. The innerspring assembly of claim 47, wherein said overlapping plies of material are interconnected by at least one connecting seam extending generally along said pocket height and axially offset from said cross seams.

49. The innerspring assembly of claim 48, wherein said at least one connecting seam is a weld seam.

50. The innerspring assembly of claim 47, wherein said overlapping plies of material are interconnected by welding.

* * * * *